United States Patent [19]

Jones

[11] Patent Number: 5,022,783

[45] Date of Patent: Jun. 11, 1991

[54] CEMENTIOUS PATTERN IMPARTING TOOL

[76] Inventor: Kenneth L. Jones, 4871 A. Jackson St., Riverside, Calif. 92503

[21] Appl. No.: 432,371

[22] Filed: Nov. 6, 1989

[51] Int. Cl.[5] ..... E01C 19/26

[52] U.S. Cl. ..... 404/122; 404/129

[58] Field of Search ..... 404/87, 89, 94, 93, 404/96, 97, 121, 122, 124, 127, 128, 129, 131, 72; 172/349, 350, 681, 713, 174, 540, 21, 22, 554; 264/293; 425/385, 162

[56] References Cited

U.S. PATENT DOCUMENTS

| | | | |
|---|---|---|---|
| 1,722,907 | 7/1929 | Liddle | 404/129 |
| 3,094,046 | 6/1963 | Zipelius | 404/93 |
| 3,910,711 | 10/1975 | Moorhead | 404/89 |
| 3,910,738 | 10/1975 | Chandler et al. | 425/162 |
| 4,105,354 | 8/1978 | Bowman | 404/72 |
| 4,131,406 | 12/1978 | Fresquez | 425/385 |
| 4,184,787 | 1/1980 | Uebel | 404/117 |
| 4,276,940 | 7/1981 | Kirkegaard | 172/42 |
| 4,475,329 | 10/1984 | Fischer | 52/704 |
| 4,722,637 | 2/1988 | Glesmann | 404/118 |
| 4,775,262 | 10/1988 | Guntharp et al. | 404/103 |

FOREIGN PATENT DOCUMENTS

| | | | |
|---|---|---|---|
| 198241 | 5/1923 | United Kingdom | 172/21 |

*Primary Examiner*—Ramon S. Britts
*Assistant Examiner*—Gay Ann Spahn
*Attorney, Agent, or Firm*—Leon Gilden

[57] ABSTRACT

The apparatus includes a vibratory drum mounted for rotation about its axis with a vibratory device mounted upon a framework overlying the drum, with a fluid dispensing cylinder mounted overlying the vibratory drum to minimize adhering of the cement in a non-hardened form upon the drum. The drum includes a pattern series of blades for imparting a predetermined pattern upon the cement surface, wherein the invention further includes the drum formed with a series of through-extending apertures extending through the drum to define a matrix of apertures therethrough for reception of fastener bosses mounted to bottom surfaces of randomly shaped blades to enable positioning of blades in any predetermined pattern upon the drum surface.

1 Claim, 4 Drawing Sheets

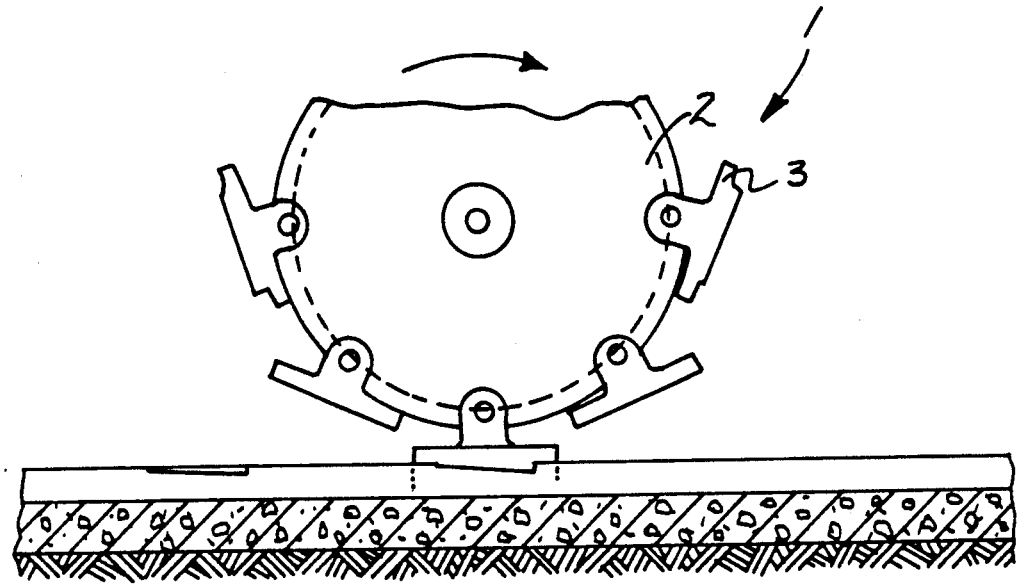
FIG 1
PRIOR ART
FIG 2
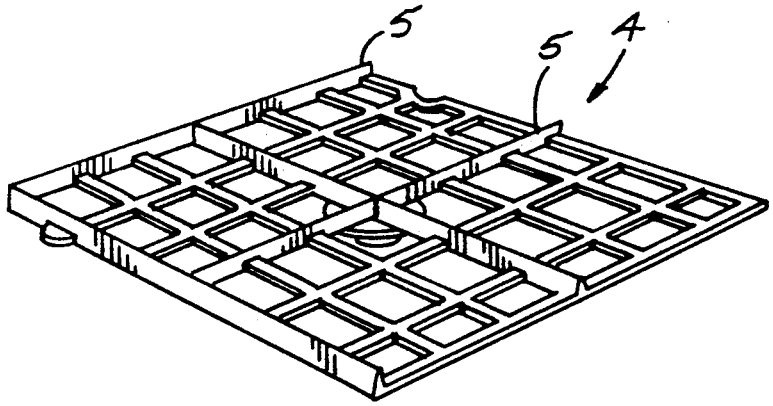
PRIOR ART

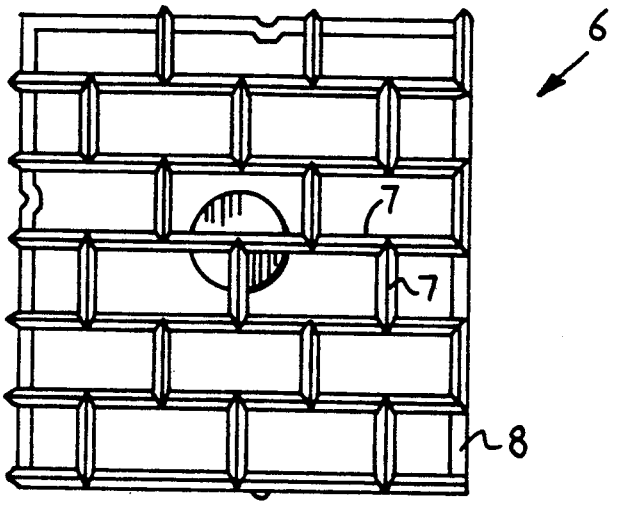
Fig 3
PRIOR ART
Fig 4
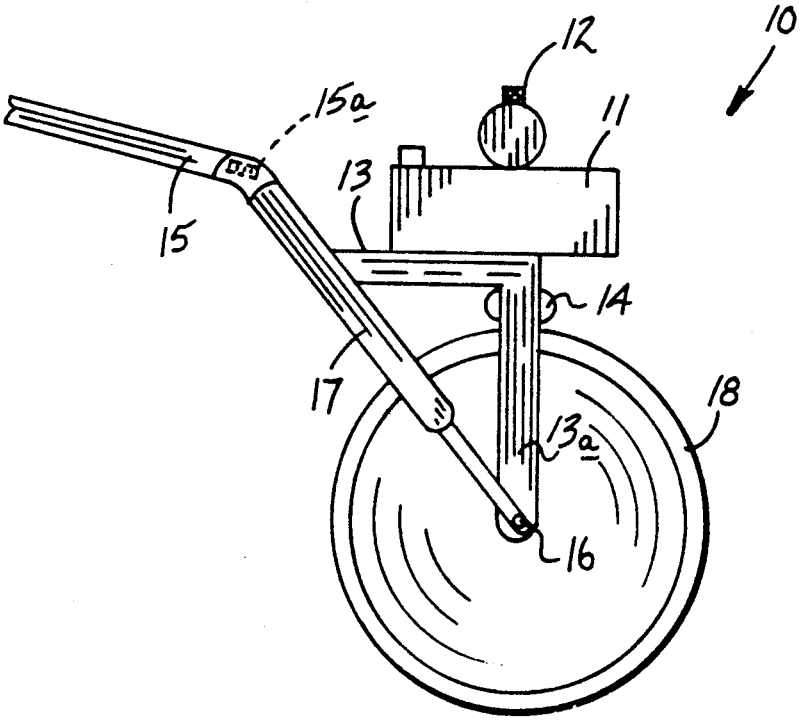

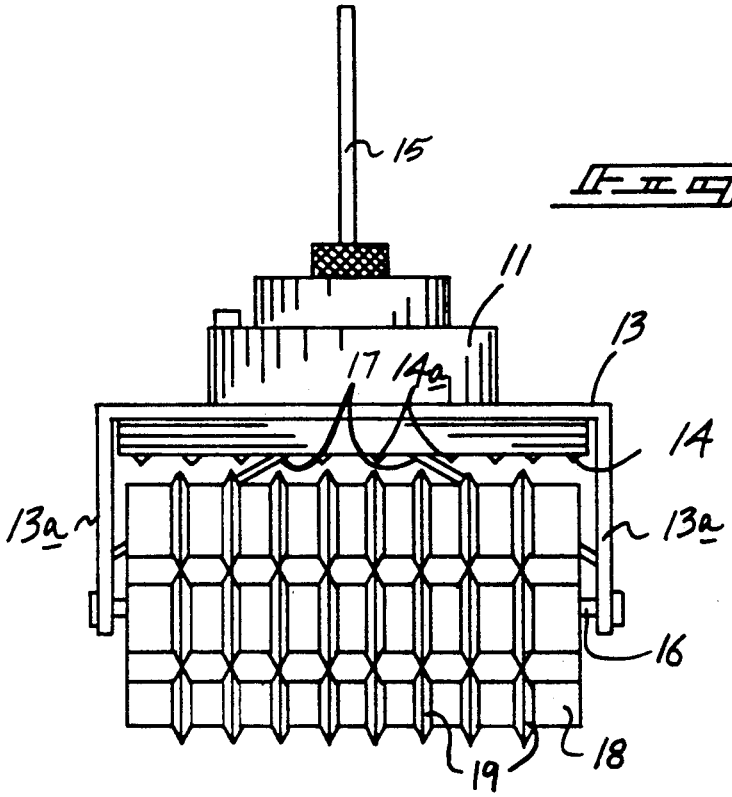
Fig 5
Fig 6
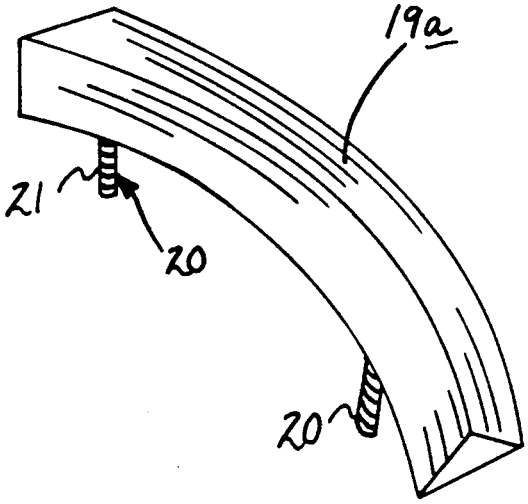

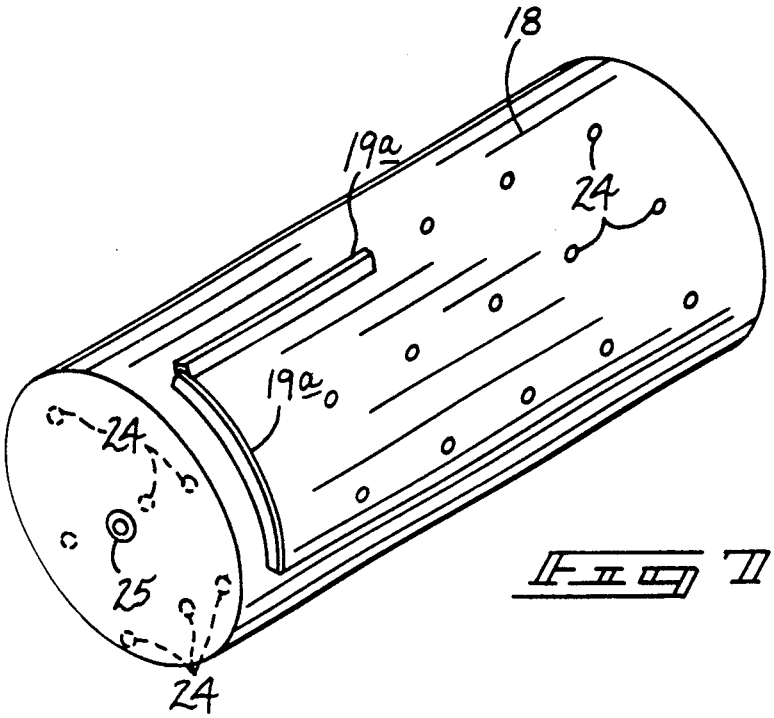
FIG 7
FIG 8
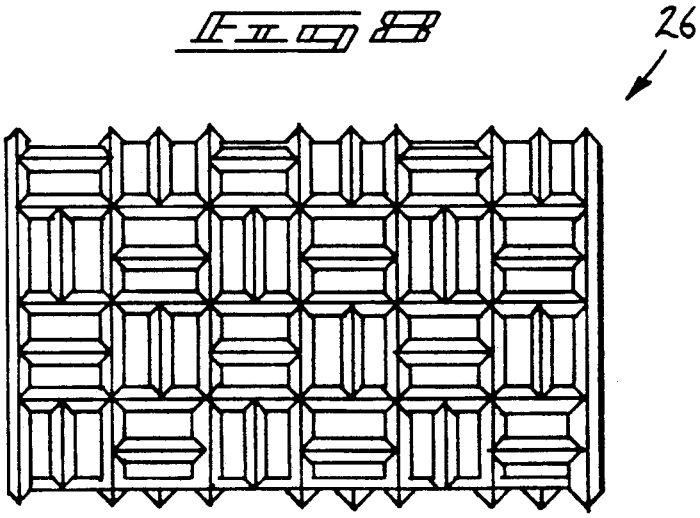

CEMENTIOUS PATTERN IMPARTING TOOL

BACKGROUND OF THE INVENTION

1. Field of the Invention

The field of invention relates to pattern imparting tools for use with cement, and more particularly pertains to a new tool in this category wherein the same utilizes a vibratory drum in coordination with random cement blades that are mounted in any desired pattern upon the surface of the drum.

2. Description of the Prior Art

It is well known in the prior art to present and dispose patterns about an uncured surface of cement or concrete in its unhardened state to provide various configurations simulating various stone configurations and furthermore for imparting patterns that may provide a friction surface on the surface of the concrete. Such tools have been widely utilized and are typically in the form of stamping tools reciprocatably mounted to impart such patterns on concrete surfaces. Roller tools have been utilized in the prior art and have been developed in various configurations for supporting pattern members on the tool. Examples of the prior art includes U.S. Pat. No. 4,131,406 to Fresquez wherein a grid of penetrating blades are formed and arranged in a stamping plane for use as a reciprocating tool to impart a pattern on concrete.

U.S. Pat. No. 3,094,046 to Zipelius sets forth a rotary drum pivotally mounting a series of pattern imparting members thereabout whereupon rotation of the drum, the pattern is thusly imparted on a surface of concrete in a manner to indicate borders and the like for use in rotary marking.

U.S. Pat. No. 4,135,840 to Puccini, et al., sets forth a random repeating pattern for use in imparting such patterns on the surface of concrete prior to its curing.

U.S. Pat. No. 1,895,045 to Moore sets forth a rotary drum utilizing a belt member to impart a coloration pattern on a roadway surface.

U.S. Pat. No. 4,776,723 to Brimo sets forth a stamping tool for use in uncured concrete of particularly configured blades to impart a predetermined pattern on the concrete surface.

As such, it may be appreciated that there is a continuing need for a new and improved cementious imparting tool wherein the same addresses both the problems of ease of use and effectiveness in construction and to this extent, the present invention substantially fulfills this need.

SUMMARY OF THE INVENTION

In view of the foregoing disadvantages inherent in the known types of concrete pattern imparting tools now present in the prior art, the present invention provides a cementious pattern imparting tool wherein the same utilizes a pattern mounted upon a rotary drum to effect pattern positioning upon an uncured concrete surface. As such, the general purpose of the present invention, which will be described subsequently in greater detail, is to provide a new and improved cementious pattern imparting tool which has all the advantages of the prior art cement pattern tools and none of the disadvantages.

To attain this, the present invention includes a drum mounted for contact rolling surface with an uncured concrete surface wherein the drum is mounted coaxially thereof within a framework incorporating a vibratory device to enhance engagement of associated cement blades mounted on the drum to impart a pattern of the blades into the uncured cement or concrete. A drum formed of resilient or solid configuration is mounted coextensively over the drum to release fluid, such as water, onto the surface of the drum as it rotates to minimize adherence of the uncured cement within the blades of the drum. The drum further includes a matrix of apertures for receiving securement bosses of the cement blades to enable mounting of the cement blades as desired within the drum. The cement blades may include serrated, threaded, or resiliently sheathed surfaces about the bosses to enhance securement of the bosses within the drum.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cementious pattern imparting tool which has all the advantages of the prior art cement tools and none of the disadvantages.

It is another object of the present invention to provide a new and improved cementious pattern imparting tool which may be easily and efficiently manufactured and marketed.

It is a further object of the present invention to provide a new and improved cementious pattern imparting tool which is of a durable and reliable construction.

An even further object of the present invention is to provide a new and improved cementious pattern imparting tool which is susceptible of a low cost of manufacture with regard to both materials and labor, and which accordingly is then susceptible of low prices of sale to the consuming public, thereby making such cementious pattern imparting tool economically available to the buying public.

Still yet another object of the present invention is to provide a new and improved cementious pattern imparting tool which provides in the apparatuses and methods of the prior art some of the advantages thereof, while simultaneously overcoming some of the disadvantages normally associated therewith.

Still another object of the present invention is to provide a new and improved cementious pattern imparting tool wherein the same utilizes a vibratory drum to direct a pattern to an uncured cement surface through selectively securable blades mounted to a drum.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic view taken in elevation of a prior art cement pattern tool.

FIG. 2 is an isometric illustration of a cement pattern blade grid utilized with a stamping tool to direct a pattern into a concrete surface.

FIG. 3 is a top orthographic view of a further prior art cement pattern tool to impart a pattern into an uncured concrete surface. FIG. 4 is an orthographic side view taken in elevation of the instant invention.

FIG. 5 is an orthographic frontal view taken in elevation of the instant invention.

FIG. 6 is an isometric illustration of a typical cement blade utilized by the instant invention.

FIG. 7 is an isometric illustration of a drum utilized by the instant invention for support of the blades.

FIG. 8 is a top orthographic plan view of a cement blade pattern utilized by the instant invention.

DESCRIPTION OF THE PREFERRED EMBODIMENT

With reference now to the drawings, and in particular to FIGS. 1 to 8 thereof, a new and improved cementious pattern imparting tool embodying the principles and concepts of the present invention and generally designated by the reference numeral 10 will be described.

More specifically, the cementious pattern imparting tool 10 of the instant invention comprises an improvement over the prior art devices, as illustrated in FIGS. 1 through 3, wherein typically, as illustrated in FIG. 1, a rotary prior art drum 1 utilizes a drum 2 with stamping pads 3 pivotally mounted thereon, wherein the pads are of limited adaptability to create various patterns on the uncured concrete surface, as illustrated. FIG. 2 illustrates a blade grid for devising blades 5 orthogonally mounted to the grid to present a particular pattern for imparting into uncured concrete, wherein FIG. 3 illustrates a brick-work pattern 6 formed with blades 7 mounted upon the support grid 8 to direct the blades into the associated uncured concrete.

FIG. 4 is illustrative of the assemblage of the instant invention wherein a framework including a horizontal support frame plate 13 with spaced downwardly extending legs 13*a* mount an associated support drum 18 by means of an axle 16 directed coaxially through the drum 18. A vibratory means 11 is mounted onto an upper surface of the horizontal frame plate 13. A plurality of triangulating links 17 are directed from the axle supporting ends of the legs 13*a* rearwardly to a handle 15 to define a yoke, with the handle 15 removably mounted within the yoke utilizing a threaded end portion 15*a*. An elongate, cement release container 14 formed with a series of aligned outwardly extending nozzles 14*a* enables imparting of a cement release fluid, such as water, onto the blade and drum structure therebelow to minimize adherence of the uncured cement to the blades during a pattern imparting procedure. The container 14 is mounted to an underlying surface of the support frame plate 13 and is coextensive with the drum 18. FIG. 5 is further illustrative of the arcuate blade pattern including a series of blades 19 fixedly mounted onto the surface of the drum 18 to provide a predetermined pattern during rotation of the drum 18 relative to an underlying uncured cement surface. The blades 19 are fixedly mounted in a releasable manner onto the surface of the drum, wherein FIG. 6 illustrates a single blade pattern 19*a* formed with an edge tapering downwardly to a base, wherein the base includes a plurality of fastener rods 20 extending downwardly relative to the base and formed with a roughened friction surface 21 that may include knurling, flutes, or alternatively, a resilient sheath extending over the blade, wherein the rods 20 are of a first diameter receivable within one of a series of matrix apertures 24 mounted through the drum to receive the rods 20. The matrix apertures are of a second diameter somewhat less than that of a first diameter defined by the rods 20 to fixedly mount the blades 19 onto the surface of the drum 18 to define a blade pattern 19, as illustrated in FIG. 5, or alternatively, a blade pattern 26 typifying a basketweave brickwork design, as illustrated in FIG. 8. The drum 18 as noted is formed with axle support openings and a collar 25 to receive the axle 16 therethrough mounted to the downwardly extending legs 13*a*.

In use, a predetermined pattern is formed on the surface of the drum 18 by selectively mounting the blades 19*a*, as desired, about the surface of the drum 18, whereupon the drum is thereafter rolled over an uncured cement surface and the desired pattern is thereby imparted.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by the Letters Patent of the United States is as follows:

1. A pattern imparting tool for directing a pattern into an uncured concrete surface, comprising, a framework including a horizontal frame member with a downwardly extending leg member mounted at each end of the framework, wherein each leg member includes an axle aperture adjacent a lower terminal end of each leg member orthogonally directed therethrough, with an axle mounted through each axle aperture, the axle including a rotatably mounted cylindrical drum mounted about the axle between each leg member, wherein the drum comprises a cylindrical drum and underlies the frame member and extends between each leg member, and a handle member mounted to the framework extending rearwardly thereof, and a plurality of blade means for selective securement about the surface of the drum, and wherein the cylindrical drum includes a matrix pattern of apertures directed through the drum about the arcuate surface thereof defining a predetermined diameter, and each of the blade means including a plurality of securement rods, the securement rods integrally mounted to a bottom surface of each blade means defining a further diameter greater than the predetermined diameter to effect an interference fit between the securement rods and the apertures, and wherein the securement rods define a roughened surface to enhance securement of each blade means to the cylindrical drum when the rods are directed through the apertures defined within the cylindrical drum, and wherein the handle includes a forward threaded end threadedly mounted within the framework, and wherein the framework further includes a plurality of rearwardly extending links extending from lowermost ends of each leg rearwardly thereof and merging at a common junction for threaded reception of the handle, and further including an elongate container mounted underlying the horizontal frame member spaced above the cylindrical drum, the container coextensive with the drum extending thereover, and the container including a series of nozzles, the nozzles mounted overlying the drum surface, wherein the container includes a fluid release agent for directing the fluid onto the drum to minimize adherence of the uncured concrete to the blade means, and wherein a vibratory means is mounted onto an upper surface of the horizontal frame member for imparting vibratory motion throughout the framework and to the drum to enhance imparting of a pattern by the blade means into the uncured concrete.

* * * * *